United States Patent [19]

Fisher

[11] 4,147,362

[45] Apr. 3, 1979

[54] CHESS GAME APPARATUS

[76] Inventor: Edward M. Fisher, 3506 Rue de Fleur, Columbus, Ohio 43221

[21] Appl. No.: 833,009

[22] Filed: Sep. 14, 1977

[51] Int. Cl.[2] ..... A63F 3/02

[52] U.S. Cl. ..... 273/282; 273/284; 273/287; 273/288

[58] Field of Search ..... 273/281, 282, 283, 284, 273/287, 288

[56] References Cited

U.S. PATENT DOCUMENTS

| | | | |
|---|---|---|---|
| 107,065 | 9/1870 | Krath et al. | 273/283 |
| 687,487 | 11/1901 | Powell | 273/281 |
| 3,168,311 | 2/1965 | Sinden | 273/1 R |
| 3,506,267 | 4/1970 | Taillie | 273/282 |
| 3,692,310 | 9/1972 | Martin | 273/284 |
| 3,993,313 | 11/1976 | Tillotson | 273/282 |

FOREIGN PATENT DOCUMENTS

| | | | |
|---|---|---|---|
| 374474 | 4/1923 | Fed. Rep. of Germany | 273/281 |
| 447965 | 8/1927 | Fed. Rep. of Germany | 273/281 |

*Primary Examiner*—Anton O. Oechsle
*Attorney, Agent, or Firm*—Mahoney & Stebens

[57] ABSTRACT

A chess game apparatus is provided having a playing board of tray-like construction and a number of playing pieces of cube-shape which are cooperatively and selectively interarranged to form both the playing surface and the game pieces. The apparatus game board includes a supporting surface having a peripheral upstanding edge wall and a spring biased retainer bar for securing the several playing pieces in relatively fixed array on the board. A number of the playing pieces are provided with the indicia of the several chess pieces. Three of the six sides of each cube-shaped playing pieces are of one color background while the other three sides are of a different color, such as black and white, so that the playing pieces can simulate and function as the alternately colored squares of a playing board. Several selected pieces function as the actual game pieces with two or more sides of each of these cubes provided with appropriate indicia for the respective indicia of a particular game piece. The number of such selected playing pieces is determined in accordance with the predetermined number of different types of moves that can be made during a game to enable the respective game pieces to be properly positioned in any designated location on the game board and to have the remaining pieces form the remainder of the playing board.

14 Claims, 6 Drawing Figures

CHESS GAME APPARATUS

BACKGROUND OF THE INVENTION

Many types of apparatus and various constructions have been employed in the fabrication and construction of apparatus specifically designed for the playing of the game of chess. The most conventional of such apparatus includes the planar surfaced playing board having the designated number of playing spaces formed by suitable indicia, such as black and white colored squares arranged in an alternating pattern on the surface of the playing board. The playing pieces are commonly three-dimensional representative of the specific game pieces, or they may be diagrammatic or illustrative in planar form and these pieces are placed on the designated playing spaces or squares. The number of game pieces, however, is substantially less than the number of the playing spaces or squares provided on the game board and thus the pieces may be readily moved from one location to another in accordance with the game rules.

Other common types of such apparatus that have been heretofore developed, includes those which include a metallic board with which magnetically cooperative playing pieces are provided for facilitating and assuring retention of the playing piece on a designated playing space. This particular type of apparatus is readily adapted to playing situations where there is a strong likelihood of dislodgment of the playing pieces as in the case of the previously described conventional game apparatus. Specifically, the magnetic type game devices are adapted for playing by persons being transported on vehicles, such as, trains, automobiles and airplanes.

Other types of game apparatus for the chess game include devices where there is a mechanical interengagement of the playing pieces with specific designated playing spaces on a game board. This form may often include a game playing device having a tongue or projection which can interfit in a suitable socket or receptacle that is formed in the game board. This interfit may be of a mechanical interference type to prevent inadvertant dislodgement or removal of a playing piece. This type of construction is also suitable for automobile use as the playing pieces will not be dislodged from the selected playing space but such apparatus constructions have the disadvantage of a non-planar upper surface as a consequence of the three-dimensional playing pieces positioned on the playing board. This non-planar or irregular surface configuration results from the fact that the playing pieces project upwardly from the playing surface and, since these pieces only occupy certain playing spaces, this results in other playing spaces which have surfaces of a different elevation.

The foregoing known types of game apparatus for the game of chess, while each particularly adapted to its specific designated purpose, are not deemed entirely suitable for the type of playing condition where a person may be involved in a number of simultaneous chess games as is commonly the occurence in the case of chess-by-mail games. For each such game, it is necessary that each player be provided with a separate and independent game board and game pieces for each opponent as that is the only means of recording the last attained move by either of players game pieces for each game. It is desirable that the game apparatus be readily storable in a convenient location without the risk of having the game pieces dislodged from their last attained position. Although it is possible to reconstruct the game, if this should occur, it is a cumbersome and time-consuming procedure to review all moves that have been made and noted in the interchange of correspondence to reconstruct the game to the last attained position. A further disadvantage with respect to the convenience of storage of the prior known apparatus, is that the known apparatus are not readily adapted to stacking to minimize the space that is occupied by several concurrently utilized game apparatus.

SUMMARY OF THE INVENTION

A chess game apparatus is provided by this invention which includes a cooperatively configured and constructed game board and number of game pieces with conplementary pieces that form a complete playing surface. The structure includes a number of independent pieces that are of identical dimensioned cube shape adapted to be secured and located in adjacent coextensive relationship on a supporting surface so that all common coplanar surfaces of the cubes will define a playing surface. Approximate indicia for the respective game pieces are formed on selected surfaces of a certain number of the playing pieces with the consequent advantageous result that the apparatus has a smooth planar surface when being used that is adaptable to stacking of one or more similar type chess game apparatus.

The supporting board includes a planar sheet having a peripherally extending, upstanding wall formed therewith and a resiliently biased element which cooperates with one wall and the several playing pieces to frictionally grip all of the game and complementary pieces into retained array on the game board. While this structure is not specifically designed to adapt to the complete inversion of the game board, as the designed resilient gripping force that is obtained is not of sufficient strength to hold the several pieces against the weight of the pieces if the game board is completely inverted although such designs are feasible. The resilient force designed in the present embodiment, however, is sufficient to assure that the pieces will be maintained in their desired position and the forming of the entire playing surface by the similar cubes thus provides a means for mechanically positioning all of the game pieces as well as those pieces merely forming the unoccupied spaces in a fixed array that is maintained until it is desired to make another move in accordance with the determination of a particular player.

A move can be readily accomplished with the apparatus by the application of a slight force which will release the clamping force produced by the resilient biasing element. This release of the clamping force enables one to sufficiently displace the cubes in any particular row as to permit a selected piece to be picked up and interchanged with any other playing piece.

These and other objects and advantages of this invention will be readily apparent from the following detailed description of an illustrative embodiment thereof and the accompanying drawings.

DESCRIPTION OF THE ILLUSTRATIVE EMBODIMENT

Figure 1:
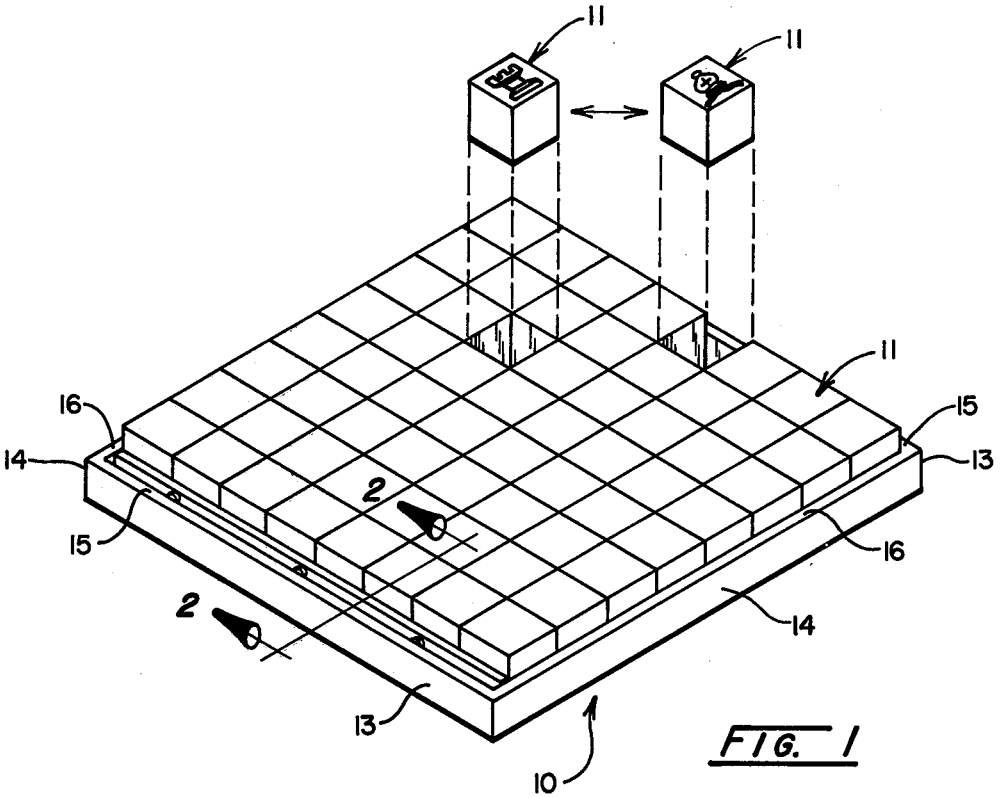
FIG. 1 is a perspective view of a chess game apparatus embodying this invention.

Having reference to the drawings, a complete chess game apparatus embodying this invention is illustrated in FIG. 1. This apparatus includes a base carrier 10 and a number of playing pieces 11. Each of the playing pieces 11 is of a similar identical shape which is advantageously of a six-sided cube shape. The number of playing pieces 11 which are incorporated in the illustrated apparatus, is shown to be sixty-four and these pieces are arranged on the base carrier 10 in the form of a square having eight of the playing pieces 11 on each side. Thus, as these playing pieces are arranged, they are oriented and positioned so that one side or face of each cube is disposed in a contiguous plane which in effect forms a playing surface that is simulative of a playing board. For a chess game apparatus, several surfaces of the respective playing pieces are provided with an appropriate indicia, or background color, or both to enable a playing piece to also simulate a respective playing space or square of the conventionally configured playing board. Accordingly, the playing pieces 11, in accordance with this invention, define and form the surface of a playing board for such a game. For this purpose, the various playing pieces are provided with the appropriately colored backgrounds so that alternate and adjacently positioned playing pieces can be positioned with a specific colored surface that is exposed and results in the alternately identifiable playing spaces which, as illustrated, may be conventionally black and white.

Figure 2:
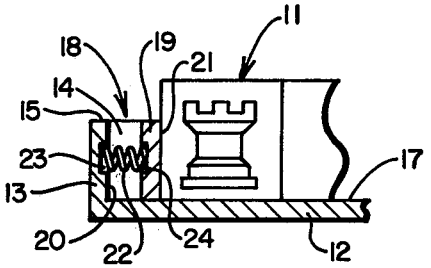
FIG. 2 is a fragmentary vertical sectional view on an enlarged scale taken along line 2—2 of FIG. 1.

Forming the base carrier 10 is a structurally rigid base plate 12 having upstanding, peripherally extending edge walls 13 and 14. These edge walls 13 and 14 are secured to the base plate 12 and project a distance upwardly terminating in an upper edge surface 15 and 16, respectively. Preferably, the height of these edge walls with respect to the upper surface 17 of the base plate 12 is substantially less than the height of the playing pieces 11 as is best seen in FIG. 2. This arrangement thus leaves an upper portion of each of the playing pieces 11 exposed or projecting above the walls 13 and 14 and thus facilitates the subsequent manipulation of these playing pieces in accordance with the procedures for operation and playing of this chess game apparatus, as is described in greater detail.

Construction or fabrication of the base carrier 10 may be in accordance with any of several well known fabrication techniques for such structures. For example, the base plate 12 and its associated edge walls 13 and 14 may be integrally molded as a one piece unit from a suitable synthetic resin material which possesses the desired structural rigidity characteristic when set or hardened. Alternatively, the base carrier, as well as its associated edge walls, may be fabricated as separate elements from suitably dimensioned materials, such as wood, with these elements then assembled into a unitary structure through the use of conventional fastening devices and assembling procedures.

In accordance with this invention, the base carrier 10 is advantageously constructed to incorporate a clamping mechanism 18 which is designed to secure the several playing pieces 11 in the illustrated assembled arrangement. This clamping mechanism 18 is mounted in the base carrier 10 in adjacently disposed relationship to one edge wall 13. For this purpose, the dimensions of the base carrier 10 are such that the length of the base in a direction parallel to the edge walls 14 is substantially greater than the cumulative length of eight playing pieces 11 so that there will be sufficient space at the one end for the clamping mechanism. Included in the clamping mechanism 18 is a clamping plate 19 which extends the full length of the interior of the edge wall 13 and has a vertical dimension that is essentially equal to the vertical height of the edge wall 13 and thus does not interfere with the manipulation of the playing pieces. This clamping plate 19 is disposed in parallel relationship to an interior surface 20 of the edge wall 13 and has a vertical surface 21 which is constantly urged into contacting engagement with the adjacent and opposed vertical wall surfaces or sides of the eight playing pieces 11 that extend the width of the base carrier.

Providing a continuous biasing force for maintaining the clamping plate 19 in engagement with the playing pieces are a number of helical compression springs 22 which are spaced in longitudinally separated relationship along the edge wall 13. These springs 22 may be conveniently secured in their respective positions by having the ends thereof disposed in shallow sockets 23 and 24 formed in the opposed surfaces of the edge wall 13 and the clamping plate 19. In the illustrative embodiment, as can be seen in FIG. 1, three such springs 22 are provided to assure that an adequate clamping force may be maintained by the plate 19 in compressing the aligned rows of playing pieces 11 against the opposite edge wall 13 and thus assure that the playing pieces will not be inadvertently dislodged from the base carrier.

As previously indicated, each of the playing pieces 11 is of a cube shape thus having six sides or surfaces which can be provided with the appropriate indicia or background coloring, or other appropriate markings, to enable one to play the game apparatus. The specifically illustrated embodiment is designed primarily for utilization in the playing of the game of chess and, to best facilitate playing, two of the sides indicated as 25 and 26 of each piece, are provided only with the background color for designating the respective playing spaces or squares of a conventional type playing board. Accordingly, the one side 25 has a black background while the other side 26 has a white background. The colors, black and white, are designated for illustrative purposes and it will be readily apparent that other selected background colors may also be utilized. The primary criteria for color is that the selected colors are capable of clearly indicating the opposite nature of the playing spaces as defined by the respective playing pieces. Each of the playing pieces may be fabricated from suitable materials, such as wood, plastic, paper, etc., that possess the necessary structural strength characteristics.

Figure 3A:
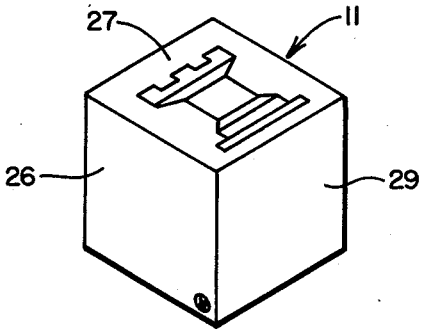
FIGS. 3 and 3*a* are perspective views of all sides of a selected specific game piece showing the indicia that is applied to six sides of a cube.
Figure 3B:
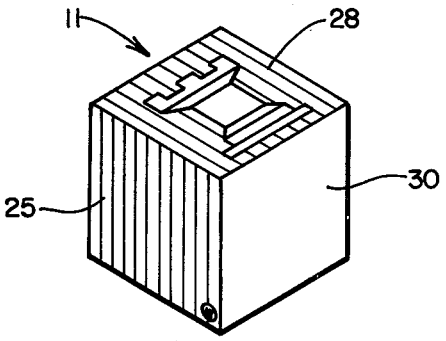

While each of the playing pieces 11 includes sides 25 and 26 formed with the appropriate background colors, it will be understood that only certain selected ones of the playing pieces 11 need be provided with the indicia associated with the respective game for a chess game. To better illustrate the indicia features for designating a particular game piece, FIGS. 3*a* and 3*b* may be referred to wherein a single playing piece is shown from two different perspective angles for simultaneous viewing of all six of the sides of that cube. Accordingly, as indicated, two of the sides 25 and 26 are provided with the only background colors which are black and white. Two of the other sides 27 and 28 which are diametrically disposed are provided with representative indicia of a specific playing piece. As illustrated in FIGS. 3*a* and 3*b*, this indicia is representative of the castle or rook and it will be noted this indicia is formed in a color that clearly contrasts the background color and may also be black and white, respectively for each of the two sides. Each of the other game pieces is similarly represented on a respective game piece to provide a complete set of the game pieces in duplicate. Where a black or white game piece indicia is to be represented in the same color background, it will be seen from FIGS. 3A and 3B that this may be readily accomplished by use of a contrasting outline or secondary background.

This indicia configuration thus enables a specific playing piece 11 which comprises one of the game pieces to be alternatively positioned in a playing space which may be of either the black or white. Consequently, each playing or game piece, may be readily positioned on the base carrier 12 in the illustrative arrangement in accordance with a designated move following the game rules and playing sequence, and may have the desired game piece thus positioned in either the white or the black playing space. Alternatively, in the event that a particular game piece is taken by an opponent, this event can be readily accommodated by positioning of that playing piece to have either the black or white side, 25 or 26, exposed at that position, or at a different position to indicate the loss of a particular game piece. The remaining two of the six sides 29 and 30 may be provided with either the black or white alternative background coloring or these sides may be provided with a different color adapted to the playing of other games of a similar nature.

Utilization of the game apparatus of this invention in the playing of the game of chess is illustrated in FIG. 1. As indicated in that figure, the upper exposed sides or surfaces of each of the playing pieces 11 are shown as they would appear having each playing piece 11 oriented to expose the desired one of the sides 25 through 28. With the game having progressed to a point where the illustrative arrangement of the assembled playing pieces has been obtained, a subsequent move or play is indicated as involving two of the playing pieces 11 which are shown removed and elevated out of the plane of the remaining playing pieces. Removal of the two indicated pieces is readily achieved by the lateral displacement of the clamping plate 19 toward its adjacent edge wall 13 in opposition to the force of the several springs 22. Lateral displacement of the clamping plate 19 thus frees the several playing pieces which may then be displaced in their respective rows in perpendicular relationship to the clamping plate 19 and enable one to insert their fingers between adjacent playing pieces to grip a particular piece and vertically lift that piece out of the base carrier. This is the operation having been considered as completed in FIG. 1 as to two of the playing pieces. At this point, the compressive force of the clamping mechanism 18 may be permitted to be reapplied as the spaces for those two playing pieces will not be closed due to the supporting relationship of the aligned pieces in other rows. Alternatively, the clamping plate 19 may be maintained in its displaced position where no clamping force will be applied.

In the illustrated move of FIG. 1, one player's bishop is shown as advancing diagonally to take his opponent's rook. In completing this play, the player would take the playing piece for his bishop and position it in the space which has been previously vacated by his opponent's rook. This is accomplished by merely inserting the playing piece into the then open space. When that operation is completed, the player then takes the opponent's rook game piece and positions it into the space that had been previously occupied by his bishop. Since the rook has now been taken, the playing piece is not placed with the rook indicia showing but is relatively rotated so that when inserted in that vacated space, it will have only a background surface showing and, in this instance, this would be the black side 25. If the move had required the game piece to be located on the opposite color playing space, then the piece would have been oriented to display the game piece indicia on the proper background at that playing space.

It will be readily seen that all other moves during the progression of a game of chess can be readily accomplished in the same similar manner. Any particular game piece may be moved to any other selected location for either positioning on an open playing space or in taking an opponent's game piece that may be located in that playing space. The advantage of this particular constructural arrangement and configuration of playing pieces is that at no time will there be any empty spaces on the base carrier. Any move of playing pieces results in an interchange of playing pieces 11 which again complete the contiguous exposed surface of all playing pieces and thus maintains a smooth planar surface. None of the playing pieces need be, or are removed from the base carrier which otherwise require storage facilities of an auxiliary nature. Game pieces, as they are lost to an opponent, are merely positioned so that they are no longer recognized as being effective on the exposed composite surface.

As a matter of convenience, however, each of the respective game pieces may be provided with additional suitable indicia comprising miniature replicas of a specific side such as 27 and 28 with that miniature indicia being located on one of the two sides 25 and 26, as indicated in FIGS. 3*a* and 3*b*. The addition of such auxiliary indicia enables a player to conveniently relocate a respective game piece without having to search through a substantial portion of the playing pieces while they are maintained in assembled relationship on the base carrier.

It will be readily apparent from the description of this illustrative embodiment of the chess game apparatus that a particularly unique and novel structure is provided to facilitate the playing of such a game. This apparatus is readily capable of retaining the several playing pieces in the desired assembled relationship to assure that the last attained positioning of any particular playing piece is maintained until such time as there is another game move involving such a playing piece. This is of particular advantage for those persons desiring to engage in a game of chess through mail correspondence. A chess game apparatus of this type is particularly adapted for such intermittent play as it is convenient to store. Several such game apparatus may be readily stacked in superimposed relationship and there is no requirement as previously indicated, for the storage by auxiliary means of the game pieces from any particular game apparatus. Consequently, there will be no resultant confusion as to the respective ones of several such game apparatus that may be concurrently employed. The storage is compact and a specific game apparatus may be conveniently selected through attachment of appropriate identification to the exterior of an edge wall for each specific opponent when it is necessary to consider that game apparatus for a subsequent play or move. Altough this inventive game apparatus is thus uniquely designed and adapted to playing of chess by correspondence, it will also be readily understood that the apparatus may be conveniently played by persons desiring to utilize the game in a conventional fixed position. For example, the apparatus may be used on a table positioned between two players, or the players may also utilize the apparatus on a transport vehicle such as a train or other similar vehicle.

Figure 4:
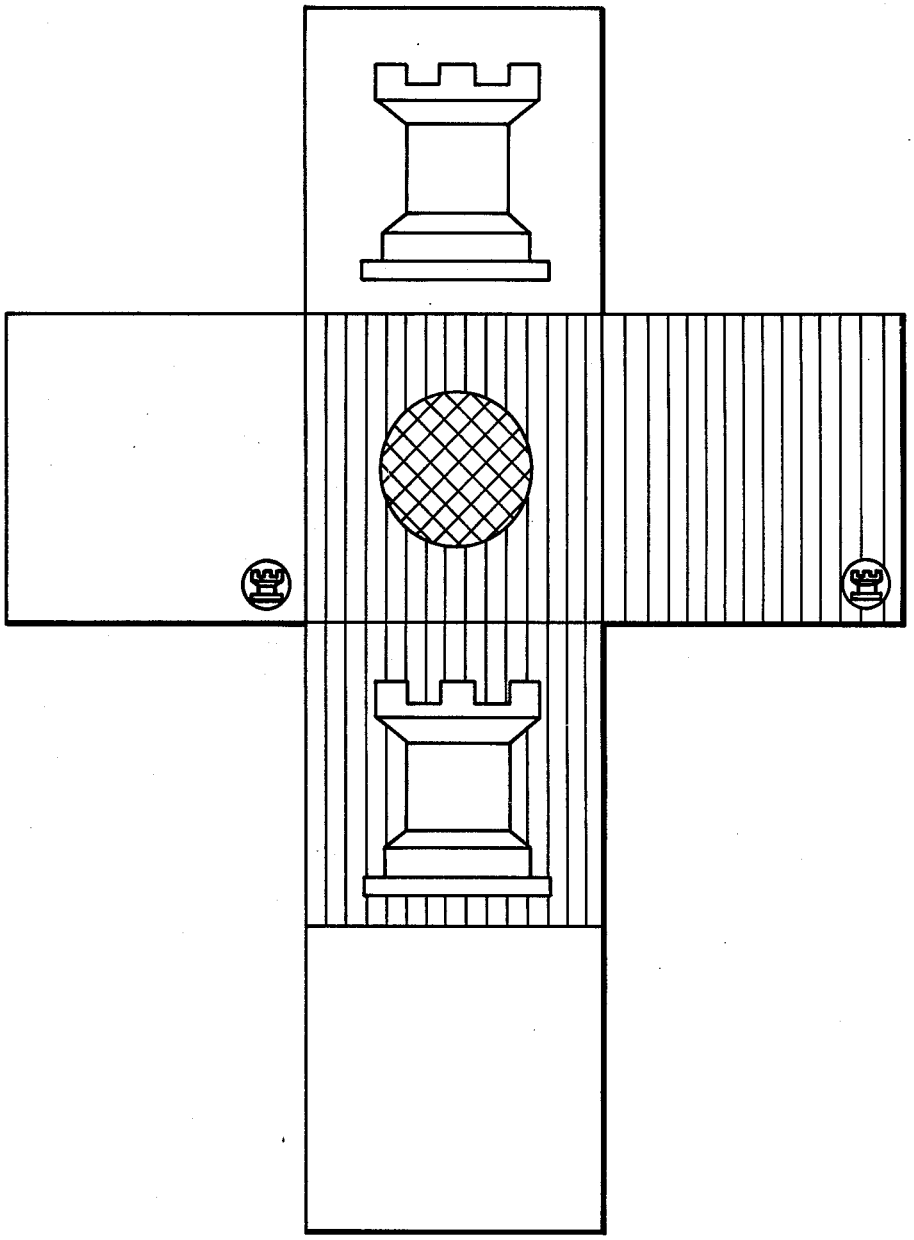
FIG. 4 is a plan view of all surfaces of a playing piece having modified indicia.
Figure 5:
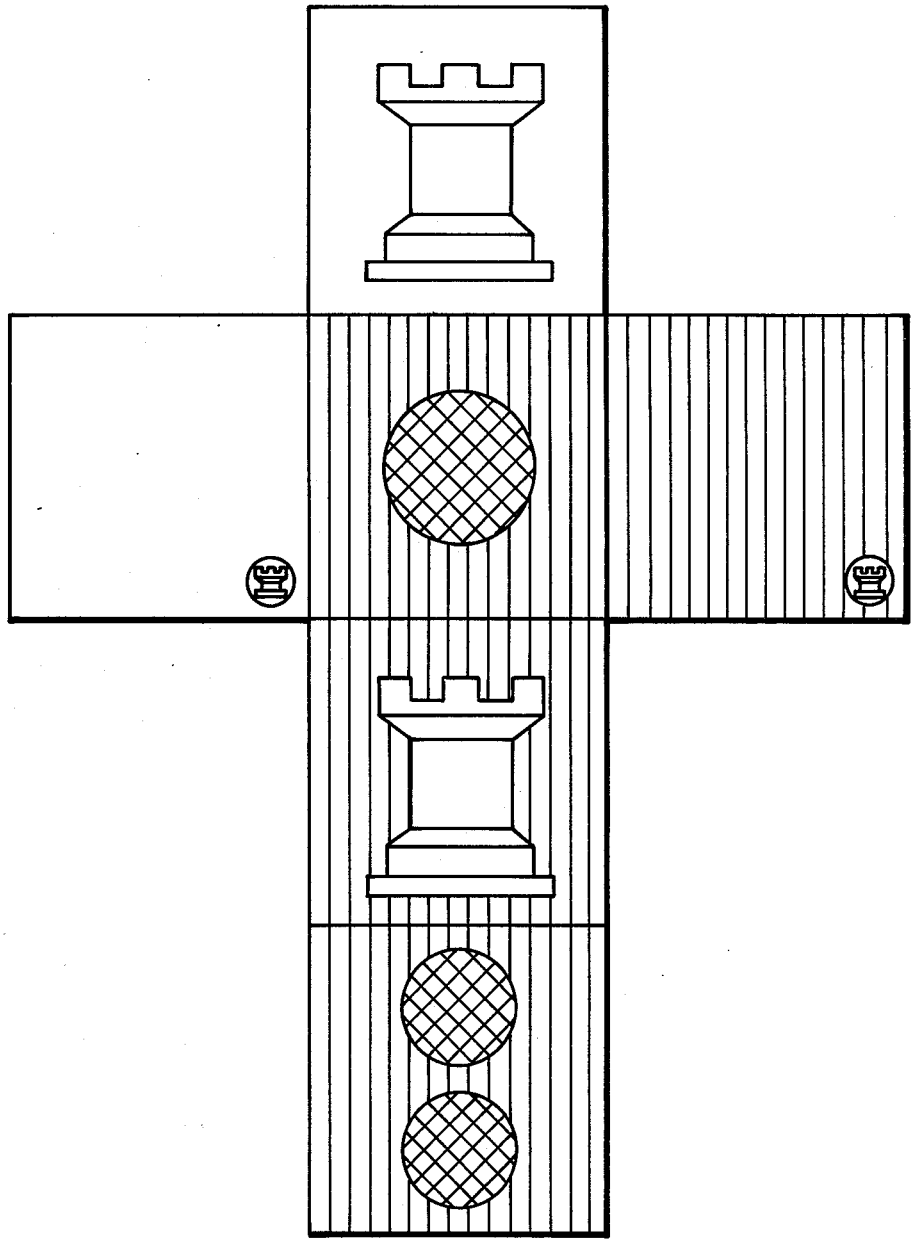
FIG. 5 is a plan view of all surfaces of a playing piece having further modified indicia.

A further feature, which can be incorporated in the illustrative apparatus, is the provision for an ancillary type game such as that of the checkers-type. It will be noted from the preceding description that two sides 29, 30 of each playing piece 11 are not otherwise utilized for the chess game. Accordingly, certain selected ones of the playing pieces 11 may have additional indicia formed on those surfaces which include the appropriate background color to indicate the opposed black or white checker game devices. This is illustrated in FIG. 4 where the six sides of a game piece are shown as rotated into a single plane for purposes of illustration. Since two of the sides 25 and 26 include the appropriate background color for unoccupied playing spaces, it will be seen that only certain of the pieces need be provided with the indicia for the checkers element. Consequently, the game of checkers may be similarly played through the moving and interchange of pairs of playing pieces to constitute a single move. Since the game of checkers also involves the forming of kings during certain stages of advancement of a particular piece, certain additional ones of the playing pieces would be provided with appropriate indicia to indicate the king status. This is indicated in FIG. 5 where another playing piece is shown with the surface all rotated for illustration in a single plane. Also, appropriate indicia may be included on other sides to indicate the checker game devices that are displayed on opposite surfaces of a particular playing piece for convenience in locating a particular game piece.

It will be readily apparent from the foregoing description of an illustrative embodiment that a novel game apparatus is provided for the playing of chess. This apparatus has the specific advantage of convenience and stability in storage that is particularly desirable for intermittent playing where a single game apparatus must be utilized for each game and a person may be concurrently involved in several games. Also, the game apparatus incorporates a clamping mechanism to assure that the several playing pieces will be retained in the base carrier.

Having thus described this invention, what is claimed is:

1. A game apparatus comprising a plurality of playing pieces of cubic configuration having planar surfaces which are adapted to be selectively positioned on a planar support surface in an assembled array having surfaces of adjacent pieces juxtaposed with each piece defining a playing space of a playing field having a predetermined number of such playing spaces with upwardly facing surfaces thereof being contiguous and each playing piece having surfaces which when placed in juxtaposition to a surface of another playing piece enable each playing piece to be selectively removed from its position in the assembled array of playing pieces and inserted in a position from which any other selected playing piece may be removed from the assembled array of playing pieces within the confines of the playing field, each of said playing pieces having two surfaces thereof provided with distinguishing indicia identifiable as to two different playing spaces, a predetermined number of said playing pieces selected to form a set of game pieces for each of two players, the game pieces in each set having at least two other of said surfaces provided with game piece indicia representative of respective ones of each of the game pieces in a set, each of said surfaces of a game piece having the game piece indicia formed thereon also being provided with a respective one of said indicia identifiable with a playing space, the two surfaces being provided with different playing space indicia.

2. A game apparatus according to claim 1 wherein one of said playing space surfaces on each game piece is provided with ancillary indicia representative of that game piece.

3. A game apparatus according to claim 2 wherein each of said playing space surfaces on each game piece is provided with ancillary indicia representative of that game piece.

4. A game apparatus according to claim 1 with a predetermined number of said playing pieces selected to form a set of game pieces for each of two players for a second game, the game pieces for said second game having one other of the surfaces provided with respective game piece indicia.

5. A game apparatus comprising a plurality of playing pieces which are adapted to be disposed in an assembled array with each piece defining a playing space of a playing field having a predetermined number of such playing spaces, each of said playing pieces being of a cube shaped configuration having a plurality of surfaces with two of said surfaces provided with distinguishing indicia indentifiable as to two different playing spaces, a predetermined number of said playing pieces selected to form a set of game pieces for each of two players, the game pieces in each set having at least one other of said surfaces provided with game piece indicia representative of each of the game pieces in a set, and a base carrier having a surface on which said playing pieces are positionable in an assembled array, and clamp means cooperatively engageable with said playing pieces for maintaining said playing pieces contacting engagement as between surfaces thereof disposed vertically to the base carrier surface.

6. A game apparatus according to claim 5 wherein said base carrier includes an elongated upstanding wall extending across one side thereof, a relating displaceable wallplate extending across a side opposite to said first mentioned wall in spaced parallel relationship, and biasing means mechanically coupled with said displaceable wall plate for urging said wall plate toward said other wall.

7. A game apparatus according to claim 6 wherein said base carrier includes an elongated upstanding wall formed on each side thereof.

8. A game apparatus according to claim 7 wherein said playing pieces are of a height to project a distance above said upstanding walls.

9. A game apparatus according to claim 7 wherein said displaceable wall plate is disposed in spaced relationship to one of said upstanding walls, and said biasing means includes mechanical springs interposed between said wall plate and said adjacent upstanding wall.

10. A game apparatus comprising a plurality of playing pieces of cubic configuration having planar surfaces which are adapted to be selectively positioned on a planar support surface in an assembled array having surfaces of adjacent surfaces juxtaposed with each piece defining a playing space of a playing field having a predetermined number of such playing spaces with upwardly facing surfaces thereof being contiguous and each playing piece having surfaces which when placed in juxaposition to a surface of another playing piece enable each playing pieces to be selectively removed from its position in the assembled array of playing pieces and inserted in a position from which any other selected playing piece may be removed from the assembled array of playing pieces within the confines of the playing field, each of said playing pieces having two surfaces thereof provided with distinguishing indicia identifiable as to two different playing spaces, a predetermined number of said playing pieces selected to form a set of game pieces for each of two players, the game pieces in each set having at least one other of said surfaces provided with game piece indicia representative of each of the game pieces in a set with one of said playing space surfaces on each game piece provided with ancillary indicia representatives of that game piece.

11. A game apparatus according to claim 10 wherein each of said game pieces has the game piece indicia formed on two other of said surfaces.

12. A game apparatus according to claim 11 wherein each of said surfaces of a game piece having the game piece indicia formed thereon is also provided with a respective one said indicia identifiable with a playing space, the two surfaces being provided with different playing space indicia.

13. A game apparatus according to claim 10 wherein each of said playing space surfaces on each game piece is provided with ancillary indicia representative of that game piece.

14. A game apparatus according to claim 10 with a predetermined number of said playing pieces selected to form a set of game pieces for each of two players for a second game, the game pieces for said second game having one other of the surfaces provided with respective game piece indicia.

* * * * *